US006428160B2

(12) United States Patent
Roy et al.

(10) Patent No.: US 6,428,160 B2
(45) Date of Patent: Aug. 6, 2002

(54) METHOD FOR ACHIEVING HIGH QUALITY AQUEOUS INK-JET PRINTING ON PLAIN PAPER AT HIGH PRINT SPEEDS

(75) Inventors: Joy Roy, San Jose; Babur Hadimioglu, Mountain View; Richard N. Ellson, Palo Alto; Robert Sprague, Saratoga; James B. Kruger, Half Moon Bay; John Lennon, Newark, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/726,100

(22) Filed: Nov. 29, 2000

Related U.S. Application Data

(62) Division of application No. 09/357,015, filed on Jul. 19, 1999.

(51) Int. Cl.[7] ..... B41J 2/01

(52) U.S. Cl. ..... 347/102; 347/100; 347/43; 101/491

(58) Field of Search ..... 347/46, 95, 100, 347/102, 105, 106, 43; 101/424.1, 491; 399/251, 233

(56) References Cited

U.S. PATENT DOCUMENTS

| | | | | |
|---|---|---|---|---|
| 4,340,893 A | | 7/1982 | Ort | 346/1.1 |
| 4,751,529 A | | 6/1988 | Elrod et al. | 346/140 R |
| 4,797,693 A | | 1/1989 | Quate | 346/140 R |
| 4,801,953 A | | 1/1989 | Quate | 346/140 R |
| 5,214,442 A | | 5/1993 | Roller | 346/1.1 |
| 5,216,442 A | | 6/1993 | Parks et al. | 346/140 R |
| 5,231,426 A | | 7/1993 | Sweet | 346/140 R |
| 5,287,123 A | | 2/1994 | Medin et al. | 346/140 R |
| 5,296,873 A | | 3/1994 | Russell et al. | 346/25 |
| 5,329,295 A | | 7/1994 | Medin et al. | 346/25 |
| 5,371,531 A | * | 12/1994 | Rezanka et al. | 347/100 |
| 5,428,384 A | | 6/1995 | Richtsmeier et al. | 347/102 |
| 5,446,487 A | | 8/1995 | Russell et al. | 347/102 |
| 5,467,119 A | | 11/1995 | Richtsmeier et al. | 347/102 |
| 5,479,199 A | | 12/1995 | Moore et al. | 347/102 |
| 5,510,822 A | | 4/1996 | Vincent et al. | 347/102 |
| 5,531,818 A | * | 7/1996 | Lin et al. | 106/23 C |
| 5,565,113 A | | 10/1996 | Hadimioglu et al. | 216/2 |
| 5,589,866 A | | 12/1996 | Russell et al. | 347/102 |
| 5,631,685 A | | 5/1997 | Gooray et al. | 347/102 |
| 5,668,584 A | | 9/1997 | Broder et al. | 347/102 |
| 5,742,315 A | | 4/1998 | Szlucha et al. | 347/102 |
| 5,754,208 A | | 5/1998 | Szlucha | 347/102 |
| 5,757,407 A | | 5/1998 | Rezanka | 347/102 |
| 5,771,054 A | | 6/1998 | Dudek et al. | 347/102 |
| 5,774,155 A | | 6/1998 | Medin et al. | 347/102 |
| 6,224,204 B1 | * | 5/2001 | Aoki | 347/106 |
| 6,283,589 B1 | * | 9/2001 | Gelbart | 347/101 |

* cited by examiner

*Primary Examiner*—Leslie J. Evanisko
(74) *Attorney, Agent, or Firm*—Fay, Sharpe, Fagan, Minnich & McKee, LLP

(57) ABSTRACT

An apparatus and method for ink-jet printing on a recording medium is provided which includes the steps of jetting aqueous ink drops on paper in the form of an image. The aqueous ink used is a slow-drying (high-surface tension) ink which does not penetrate the paper/paper fibers for a relatively long time. Prior to penetration of the paper/paper fibers, the water in the droplet is quickly evaporated from the ink while still resident on the paper surface. The evaporation process is substantially completed prior to an additional liquid ink being jetted onto the same or adjoining location of the recording medium. The evaporation is rapid enough to prevent the resident ink from substantially migrating/wicking to any adjacent location or into the recording medium. Further the drying energy is transferred to the resident ink spots from the same direction as the printheads ensuring less energy requirement.

21 Claims, 4 Drawing Sheets

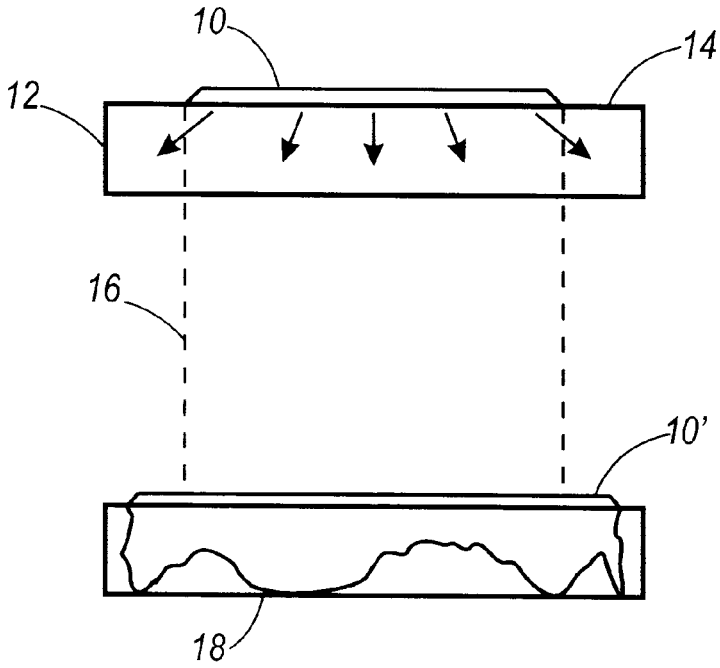
FIG. 1A
FIG. 1B
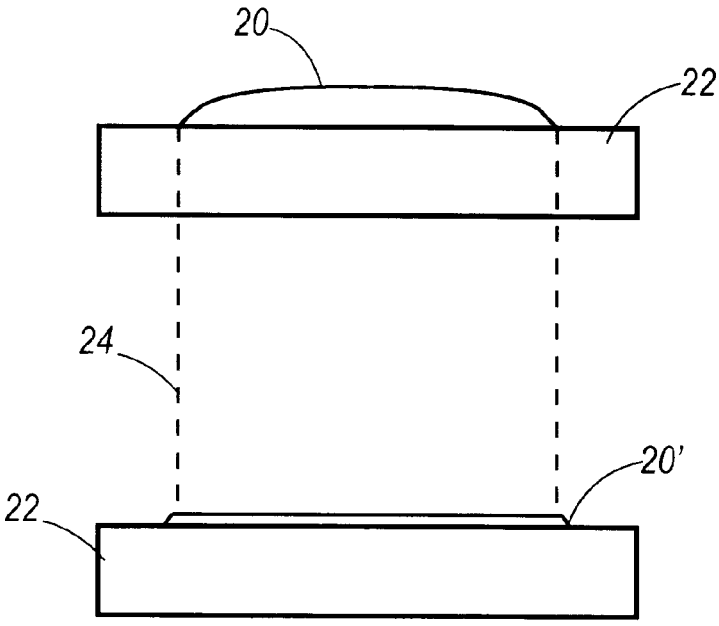
FIG. 2A
FIG. 2B

METHOD FOR ACHIEVING HIGH QUALITY AQUEOUS INK-JET PRINTING ON PLAIN PAPER AT HIGH PRINT SPEEDS

This application is a divisional of U.S. Ser. No. 09/357,015 filed Jul. 19, 1999.

BACKGROUND OF THE INVENTION

This invention relates generally to liquid ink-jet printers and more particularly to the use of high surface tension slow-drying ink which is dried in a manner to maintain high image quality. While not limited to, the present invention finds particular benefits when used in conjunction with acoustic ink printing.

Acoustic ink printing is a potentially important direct marking technology. It compares favorably with conventional ink-jet systems for printing either on plain paper or on specialized recording media while providing significant advantages of its own.

Drop-on-demand and continuous-stream ink-jet printing systems have experienced reliability problems because of their reliance on nozzles with small ink ejection orifices which easily clog and which limit the life as the size of an ejected ink droplet is decreased. Acoustic printing obviates the need for such nozzles, so it not only has a greater intrinsic reliability than an ordinary ink-jet printing system, but also is compatible with a wider variety of inks, including inks which have relatively high viscosities and inks which contain pigments and other particulate components. Furthermore, it has been found that acoustic printing provides relatively precise positioning of the individual printed picture elements ("pixels"), while permitting the size of those pixels to be adjusted during operation, either by controlling the size of the individual droplets of ink that are ejected or by regulating the number of ink droplets that are used to form the individual pixels of the printed image. See a co-pending and commonly assigned U.S. Patent Application of Elrod et al. which was filed Dec. 9, 1986 under Ser. No. 944,286 on "Variable Spot-Size Acoustic Printing", hereby incorporated by reference.

When an acoustic beam impinges on a free surface (i.e., liquid/air interface) a pool of liquid from beneath the radiation pressure which the beam exerts against the surface of the pool reaches a sufficiently high level to release individual droplets of liquid from the pool, despite the restraining force of the surface tension. Focusing the beam on or near the surface of the pool intensifying the radiation pressure it exerts for a given amount of input power. The basic principles of acoustic-ink printing are well known and the subject of numerous commonly assigned U.S. patents.

A specific benefit of acoustic-ink printing is the ability to generate droplets which are of a much smaller size than the orifice through which the droplets are ejected. It has been found that acoustic-ink printing can generate droplets which are a magnitude smaller in size than that of the orifice opening, and significantly smaller than existing conventional ink-jet printer systems. This allows an acoustic-ink printing system to generate high resolution images not previously obtainable, since a key factor in obtaining high resolution is depositing the smallest spot possible on a recording medium.

However, in existing printing methods, both for conventional ink-jet printing and acoustic ink printing, the present practice is to use fast penetrating inks (also known as fast drying or low surface tension inks) for aqueous ink-jet printing. The fast penetrating inks are those which will commonly penetrate into plain paper fiber in less than three seconds allowing the ink to spread quickly on the surface of the paper and also seep into the paper.

A benefit of using fast drying inks is in conjunction with color printers, in order to reduce inter-color bleeding which would commonly occur if using slow drying inks, also known as high surface tension inks.

Another benefit of using fast drying inks for color printing is that as the inks are laid down on the print medium (e.g. paper such as plain paper), when a second color ink is placed down on that location or adjacent thereto, the first laid down ink will not tend to be on the surface, i.e. it will already have been absorbed into the paper. Therefore, the second laid down ink will not run over the first ink. The fast penetrating ink wicks into the paper before the second color ink is jetted onto the same paper surface. Additionally, the penetration of the first ink is rapid enough that lateral migration into adjacent locations previously printed is reduced, thereby diminishing inter-color bleed, which would normally occur under conventional techniques of printing with slow drying inks.

However, there are several drawbacks to use of fast-drying inks. Particularly, by having the ink penetrate into the paper some portion of the colorant or dye is also transported into the paper. This results in low optical density of the printed materials and also greater show-through when viewing the paper from the non-printed side. Specifically, the more colorant which is moved into the paper lowers the amount of colorant which can be visualized by a viewer, since the fibers will block the colorant from view.

Existing conventional ink jet printing machines which use fast drying inks can expect to obtain 1.2 to 1.3 optical density, when using plain paper. This is compared to high quality xerography at 1.8 to 2.0 and photography at 2.1 to 2.3 optical density.

A drawback of backside show-through is the inability to do duplex printing. Particularly, since the use of fast drying ink will, in many cases, cause the ink to wick through to the opposite side of the paper, two-sided printing would not be possible, since the ink which shows-through to the opposite side would ruin the second print.

The fast penetration/wicking characteristic of fast-drying ink into the paper also has the effect of some lateral wicking depending on the surface topology of the paper. This causes a poor edge sharpness on printed lines and text.

As discussed in U.S. Pat. No. 5,771,054 to Dudek et al., commonly assigned and hereby incorporated by reference, high-edge-sharpness is desirable in any printer. The typical goal is a laser-quality print. Color printers typically focus on the quality of the color reproduction and have less concern for edge definition. Black ink-jet printers that can yield sharp edges on plain paper are inherently slow-drying. This means that a page will still be wet and smudgable when output unless substantial amounts of drying time and/or thermally assisted drying are provided. Acoustic ink printing is desirable for its ability to provide edge-sharpness, without ragged edges, since it can apply such small drops which allow for a high dots-per-inch value.

When color printing, inter-color bleed is reduced by the use of fast-drying inks. While fast-drying inks have lower edge definition, in existing systems, they are still used for color reproduction. Also for existing systems, a color printer might use a slow-drying ink for monochrome black text and graphics, and use fast-drying color inks for color reproduction. Under this use, it is common that the slow-drying of the black ink causes inter-color bleed when used with color inks in normal printing or it will require substantial drying time.

A key aspect of printing is to remove the liquid from the ink droplets deposited on the recording medium. For example, liquid can be removed from the ink and printed medium by a number of methods. One simple method is natural air-drying in which the liquid component of the ink deposited on the medium is allowed to evaporate without mechanical assistance resulting in natural drying. Another method is to send the printed substrate through a dryer to evaporate the liquid. In some cases a special paper is used in which the liquid is absorbed by a thin coating of absorptive material deposited on the surface of the paper. Blotting of the printed medium is also known.

In the case of natural drying, almost 100% of the liquid is absorbed into the paper and is then, over a long period of time, evaporated naturally. The absorption and de-absorption of water into and out of the paper, however, has some undesirable side effects, such as a long drying time, strike through, feathering at edges of the printed image, paper curl and paper cockle. In the case of paper cockle, the absorption and de-absorption of the water relaxes the internal stresses of the paper, resulting in cockle. Cockle is also a function of the amount of liquid deposited per liquid area. Less printing on a paper has less potential to develop cockle due to the small amount of liquid. More printing on a paper has more cockle potential due to a higher amount of liquid per unit area. Cockle can also be induced by heating the paper, which results in stress relief.

Various drying mechanisms for drying images deposited on recording mediums are illustrated and described in the following patents which may be relevant to certain aspects of the present invention are hereby incorporated by reference, including U.S. Pat. Nos. 5,742,315, 5,231,426, 5,754,208, 5,757,407, 5,631,685, 5,771,054, and 4,751,529. The concept of drying disclosed in these patents is primarily directed to applying heat from the backside of the paper being printed on and generally to perform the drying after completion of the printing process.

It is therefore an object of the present invention to provide a printing and drying method and apparatus which enables high quality aqueous ink-jet printing on a recording medium at high speeds. The aspects of high quality that this method and apparatus enables is high optical density, high edge sharpness, low inter-color bleed, low show-through, and the absence of paper cockle. The high quality printing is obtained in part by maintaining the drop size placed on a paper area by avoiding substantial wicking of the ink laterally on and into the recording medium. The objects of the invention are achieved by use of high-surface tension (slow drying) inks in a manner considered inappropriate by conventional standards.

SUMMARY OF THE INVENTION

In accordance with one aspect of the present invention there is provided an ink-jet printing apparatus for printing on a recording medium such as plain paper as well as other types of paper. The ink printing apparatus jets aqueous ink drops on the paper in the form of an image where the aqueous ink is a slow penetrating ink which does not penetrate the paper/paper fibers for a relatively long time, on the order of greater than three seconds. Further provided is a drying system which allows for rapidly evaporating the water from the ink while the ink is still resident on the paper surface. The evaporation process is provided to substantially dry the initial ink before a second ink is jetted onto the paper at substantially the same, adjoining or other location. The evaporation or drying process is rapid enough to prevent the deposited ink from substantially migrating/wicking to any adjacent location of the paper which has or does not have ink laid thereon.

A primary advantage of the present invention is maintaining high-quality, high-density printing with high-edge sharpness, low inter-color bleed, low show-through, and the absence of paper cockle.

BRIEF DESCRIPTION OF THE DRAWINGS

The present invention may take form in various parts and arrangements of parts or in various steps and arrangements of steps. The drawings are only for purposes of illustrating a preferred embodiment and are not to be construed as limiting the invention.

FIG. 1A is a cross-sectional view which shows a fast-drying ink which has been placed onto a paper surface;

FIG. 1B is a cross-sectional view which illustrates the fast-drying ink on the paper surface of FIG. 1A after a predetermined time period;

FIG. 2A is a cross-sectional view which illustrates a slow-drying ink after it has been placed on a surface for a time period identical to the fast-drying ink of FIG. 1A;

FIG. 2B is a cross-sectional view which illustrates the slow-drying ink of FIG. 2A on a surface of a paper for an identical time as the fast-drying ink of FIG. 1B;

DETAILED DESCRIPTION OF THE PREFERRED EMBODIMENT

Figure 3:
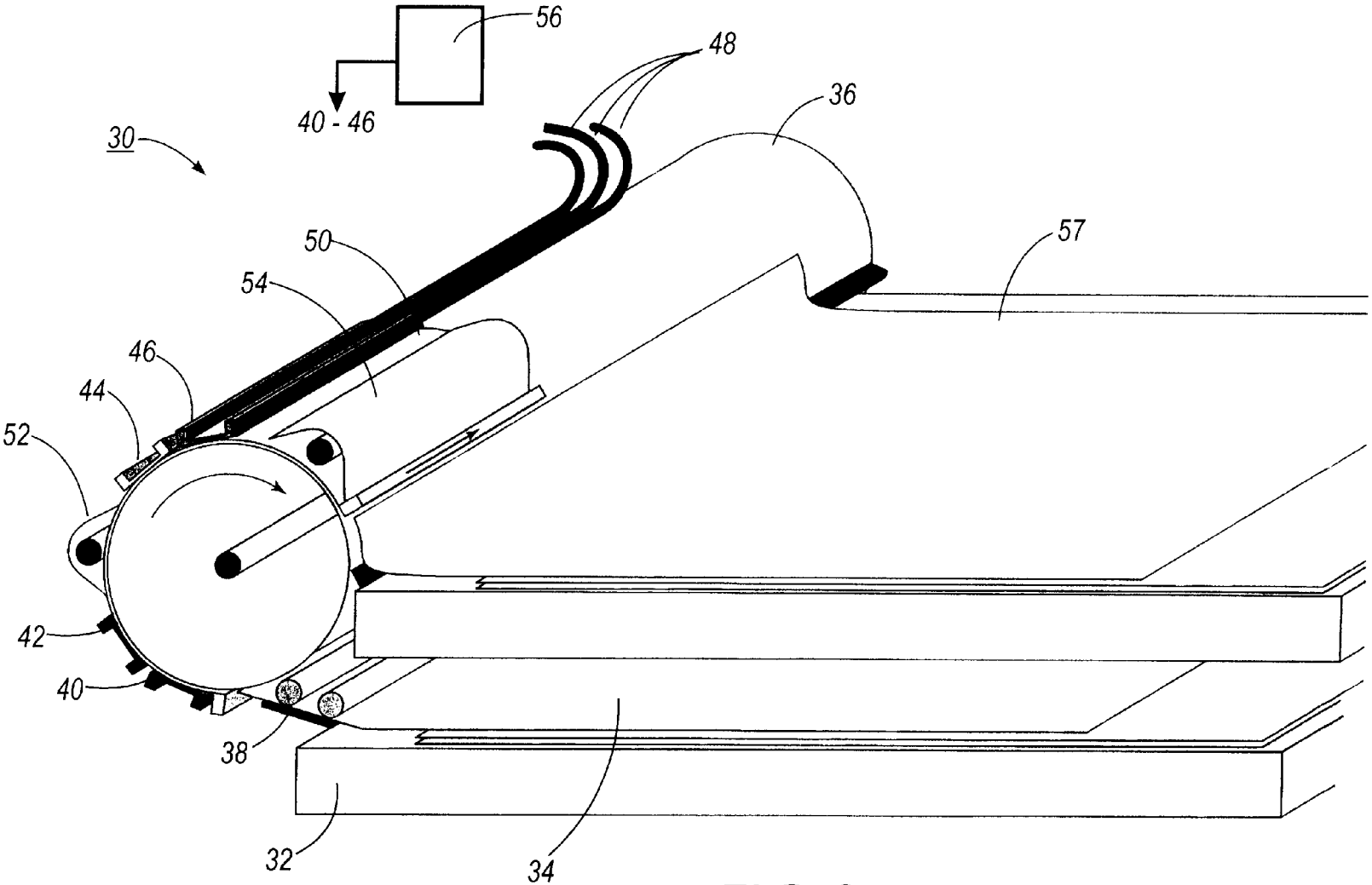
FIG. 3 depicts a printer architecture for one embodiment of the invention.

While the invention is described in some detail herein below with reference to certain illustrated embodiments, it is to be understood that there is no intent to limit it to those embodiments. On the contrary, the aim is to cover all modifications, alterations and equivalents falling within the spirit and scope of the invention as defined by the appended claims.

Turning now to the drawings, and at this point especially to FIG. 1, there is shown a droplet of fast-drying ink (also known as low surface tension ink) 10 which has been placed on the surface of a recording medium such as paper 12, shown in cross-section. A fast-drying ink has certain attributes, among these are the characteristic of spreading out onto the surface of the paper, and quickly wicking or penetrating into fibers of paper 12 such that it passes through the surface 14 of paper 12. This spreading out includes a lateral migration, causing the ink to cover an area undesirably larger than the original circumference 16 of the deposited ink. FIG. 1B shows the remaining colorant 10' of fast drying ink droplet 10 of FIG. 1A after it has entered a substantially dry state due to removal of liquid in the droplet. As can be seen, the size of the remaining colorant 10' is substantially larger than the original size of the droplet placed onto the paper. Additionally, colorant 10' is shown to have seeped through to the backside 18 of paper 12. This illustrates ink show-through which occurs when using fast-drying inks which quickly wick or penetrate into the fibers of the paper.

Turning to FIG. 2A, depicted is a droplet of slow-drying ink (alternatively called high-surface tension ink) 20. Ink droplet 20 has been on paper 22 for the same amount of time as ink droplet 10 of FIG. 1A. As can be seen, the high surface tension of this ink causes the droplet to have greater angles to the paper surface than that of droplet 10 of FIG. 1A. Whereas a fast-drying ink such as in FIG. 1A tends to have a penetration time of less than three seconds, a slow-drying ink will have a penetration time of greater than three seconds. Under the teachings of the present invention, ink droplet 20 is actively dried in a fast drying process to evaporate water from the droplet, leaving colorant 20' on the surface of paper 22 as shown in FIG. 2B. As illustrated in FIG. 2B, the colorant is substantially located on the surface of paper 22, and unlike the colorant of FIG. 1B, has not spread out substantially past its circumferential area 24. In other words, the small droplets placed on the paper are inhibited from expansion, thereby maintaining the high resolution of the image.

Additionally, the colorant has not seeped into the interior of paper 22. The benefits of this are that the optical density of the color to a viewer will be much greater than that of FIG. 1B's colorant, since the colorant of FIG. 2B is not blocked by being held in the fibers of the paper. Further, since the size of the dried colorant is substantially the same circumference or size of droplet 20, it is possible to generate high-edge sharpness that is not achievable by use of the printing methods used in FIGS. 1A and 1B. Further, when an additional color is laid down on the same or other location of the paper, since the first color is already dried, inter-color bleeding is eliminated. Also, since the colorant has been maintained on the surface of paper 22, there is not colorant show-through on the backside of the paper.

Thus, FIGS. 2A and 2B illustrate characteristics of the present invention which employs concepts counter to those used in existing operations of liquid-ink printing. Particularly, it is the conventional belief that it is best, in color printing, to use fast drying inks which are absorbed by paper fibers in order to quickly dry the paper for a next application of ink. On the other hand, the present invention takes an opposite approach which is to keep the ink droplets on top of the paper and then actively dry the ink droplets by applying heat during the printing process. This maintains the ink droplets in a small uniform manner similar in size and shape to the original deposited drops, which in turn maintains the high-image resolution.

The present invention includes other improvements over existing systems. Since existing systems allow the ink to penetrate into the fibers, it is necessary to pull the moisture out of the fibers. In particular, they allow the moisture to come in the front surface of the paper, then they pull the moisture out from the back side of the paper through backside heating. This is an inefficient manner of removing the moisture. The present invention heats the ink droplets by front-side heating prior to the liquid substantially entering into the fibers of the paper. Less energy is required in the present invention, because it is not necessary to unwet the fibers, i.e. dry out the fibers and create new free energy fibers again. Thus, the front-side drying which is described below, is determined to be preferable when one wishes to increase the throughput of the printing machine.

For example, if ten pages a minute are to be printed, the machine will have only six seconds to print before the next sheet comes through so there will only be six seconds before it is necessary to take that sheet out and put another sheet of paper on top of it. This does not allow for passive drying but rather requires a fast-active drying solution. Drying the ink on the same side on which it was deposited requires less energy when high-surface tension ink is used since the ink has not yet substantially entered the paper fibers. While the present invention could be performed with backside drying, such a configuration would slow the printing process.

Turning to FIG. 3, illustrated is a first embodiment of a printing system implementing the concepts of the present invention. Printing system 30 includes an input tray 32 containing a supply of paper 34. The paper is moved out of input tray 32 into engagement with drum 36. Paper from input tray 32 may be preheated by preheat element 38 prior to engaging drum 36. In this embodiment drum 36 is a four-inch diameter drum at 60° C. It is to be appreciated drums with other characteristics may also be used.

Printheads 40, 42, 44 and 46 are located exterior to drum 36 in a fashion whereby droplets emitted from the printheads are deposited on paper 34. Ink supply lines 48 supply ink from a supply source (not shown) to printheads 40–46. A curved carriage 50 is used for carrying printheads 40–46. Located within operational distance of drum 36 are dryers (heater) 52 and 54. In this embodiment, printhead 40 is a magenta printhead, printhead 42 is a black printhead, printhead 44 is a yellow printhead, and printhead 46 is a cyan printhead. It is to be appreciated however, that the present invention would work in a single-color system such as a black system or a system having colors other than CMYK. Printer 30 is designed to produce 10 pages per minute.

Printheads 40–46 are positioned in two banks of 40–42 and 44–46 around drum 36. In this embodiment, dryers 52, 54 are considered to be radiant heaters, however, other types of drying devices may be used, such as microwave, air, gas, reflective, conductive or other drying sources, which would allow for fast drying of the ink.

As paper 34 is moved by spinning drum 36, first color printhead 40 jets-ink onto paper 34, which then moves past dryer 52. Next, printhead 44 prints on the same, adjoining, or other paper location. Then paper 34, with the second color, is moved past and substantially dried by second dryer 54, during the first drum rotation. During the second drum rotation third color printhead 42, may print onto paper 34, and thereafter dryer 52 substantially dries drys this newly supplied ink. This process is repeated when fourth printhead 46 prints color which is dried by second dryer 54.

The heat applied to the ink drops enables printing with one color followed substantially immediately by an active evaporation/drying stage. Also, in this architecture, the amount of energy supplied to the dryer is adjusted according to the amount of ink just deposited by one of printheads 40–46, by computing image data for that printhead. Control of the output of dryers 52 and 54 is accomplished by controller 56. This method optimizes drying/evaporation of the ink on the paper and prevents under-drying (paper-cockle) or over-drying (paper scorch). Adjusting the amount of heat energy transmitted to a surface of a print medium is known in the art, examples of this are shown in U.S. Pat. Nos. 5,329,295 and 5,214,442, hereby incorporated by reference. Once the printer has completed its second rotation, the printed paper is deposited in output tray 57.

Figure 4:
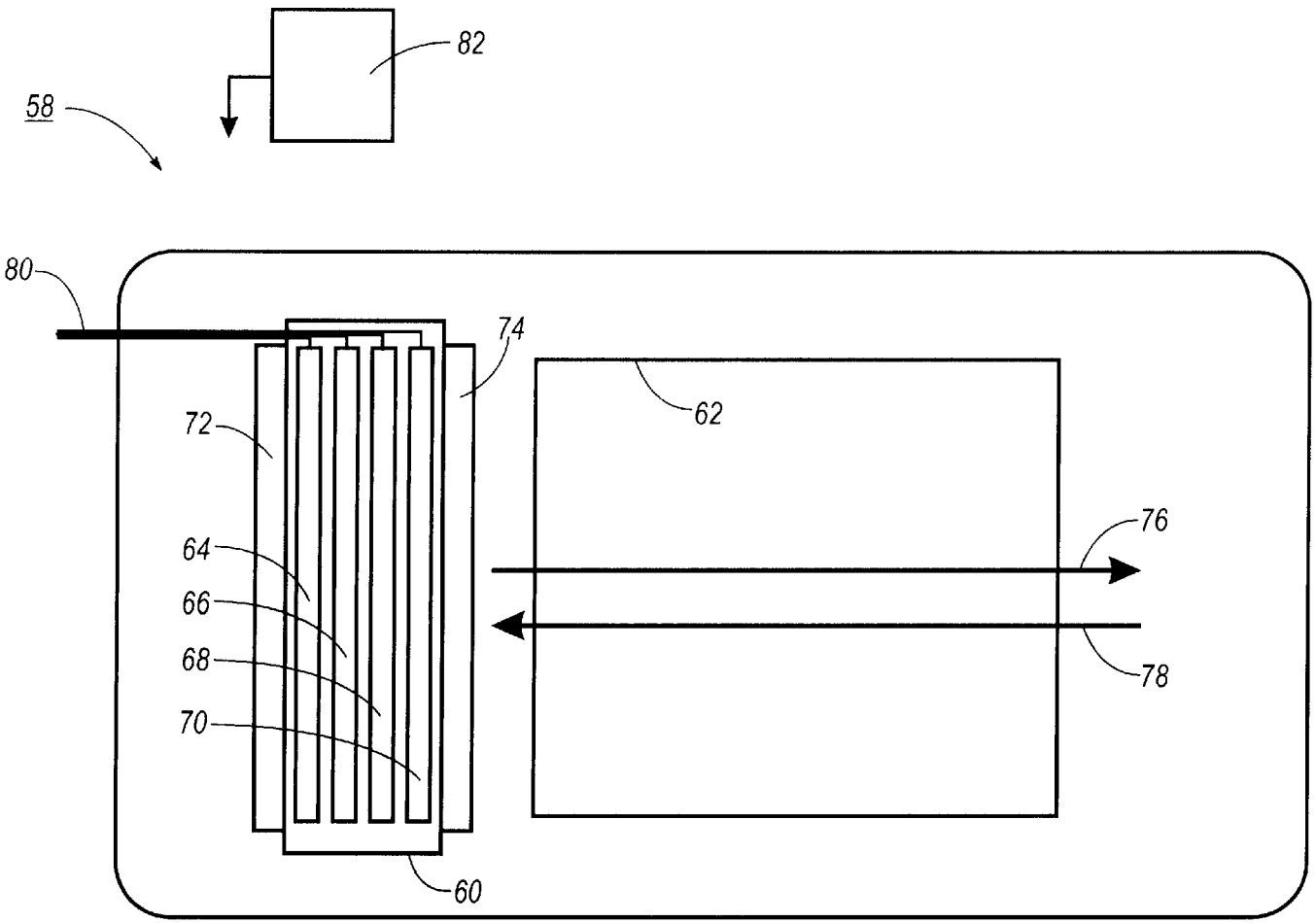
FIG. 4 illustrates a second embodiment of the invention.

FIG. 4 is a top view illustrating a second embodiment of the present invention designed to work in conjunction with a flat printing system 58, which includes printhead assembly 60 configured as a page-width array extending substantially the full width of recording medium such as paper 62. The paper is maintained in a stationary position as printhead assembly 60 is moved. Printhead assembly 60 includes printheads 64–70. Also carried on printhead assembly 60 are heaters 72 and 74. During a first pass in direction 76, one of selected printheads 64, 66, 68, 70 lays down ink droplets. The ink being a slow-drying (high-surface tension) type ink.

As this ink is jetted onto the paper surface, trailing dryer 72 dries the laid down ink. Upon passing in direction 78, the process is repeated with another printhead and use of dryer 74. Dryers 72 and 74 may be the radiant heaters or other drying devices discussed in connection with FIG. 3.

Printhead 60 again moves in direction 76 and then direction 78, repeating the process of depositing ink droplets from remaining printheads 68 and 70, if necessary, and drying the ink droplets with the associated trailing heaters 72 and 74 as appropriate. It is to be appreciated, that an important aspect of this embodiment is that prior to the laying down of a subsequent high-surface tension ink from one of printheads 64–70, the heater elements 72 or 74 have substantially dried the just laid down ink. In this manner the same benefits achieved in the previous embodiment are accomplished. It is to be appreciated that while in this embodiment, the dryers 72, 74 are shown attached to the printhead assembly 60, they may be on a separate tracking assembly which allows them to dry ink droplets in the manner described above.

Further, ink is supplied to printhead assembly 60 through transmission lines 80 from an ink supply source (not shown). Further, a controller 82 is designed to supply the printhead assembly 60 with a desired data image to be printed and may also include (or as a separate controller not shown) a manner of determining the amount of ink a printhead will deposit on an image and thereby adjust the energy level of the appropriate heater 72 or 74. This concept is equally applicable to the embodiments shown in FIGS. 3 and 5.

Figure 5:
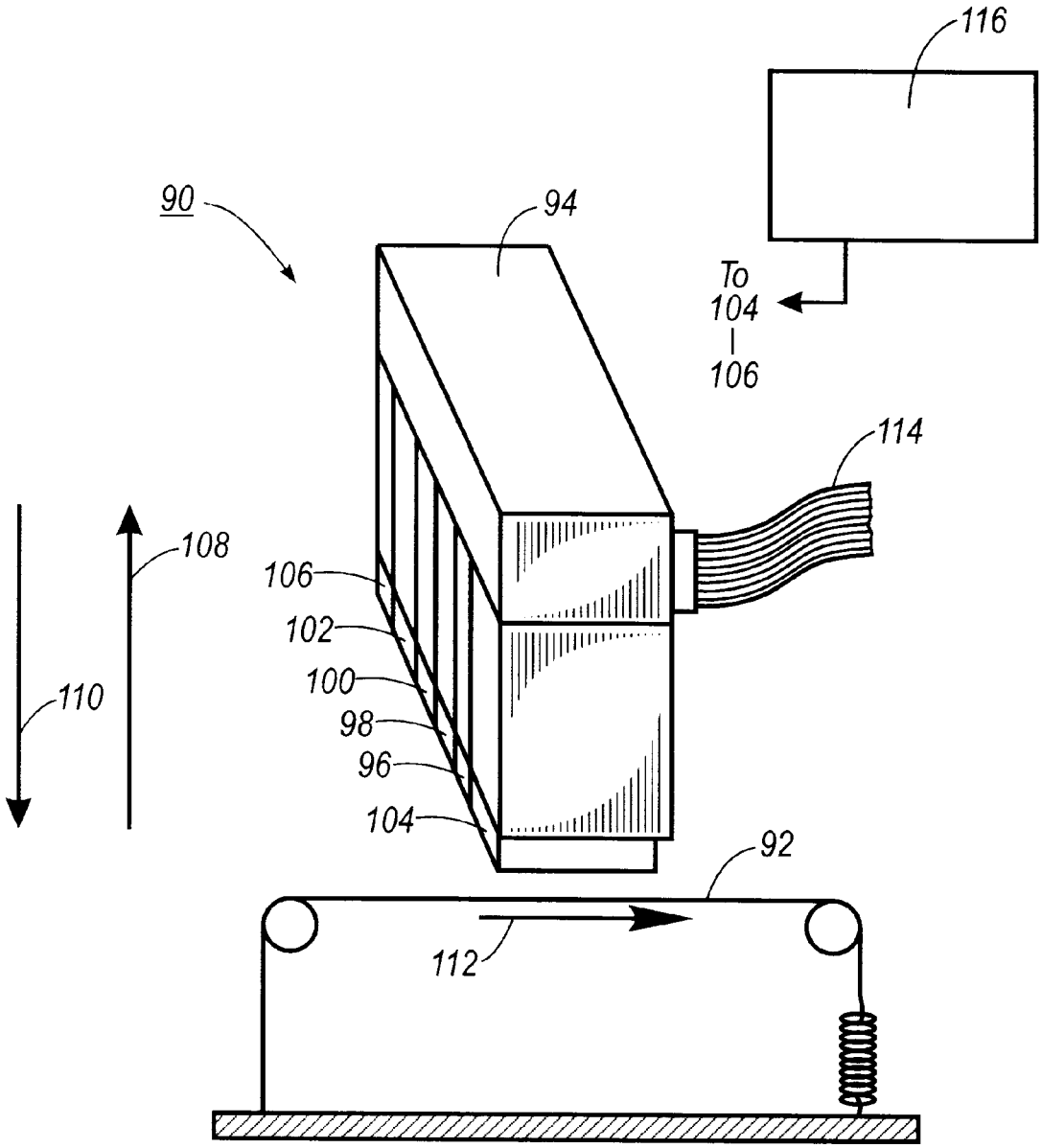
FIG. 5 illustrates a third embodiment of the invention.

Turning to FIG. 5, illustrated is a third embodiment of the present invention for use with a partial width array type printing device 90 which is shown in side view. In this embodiment, recording medium 92 is printed on by partial width array printhead assembly 94 including printheads 96, 98, 100, 102. Also carried on partial width array printhead assembly 94 are heaters 104 and 106. Printhead array 94 traverses reciprocally in directions 108 (going into the drawing sheet) and 110 (coming out of the drawing sheet). An example of operation for this embodiment includes applying ink from printhead 102 and drying of that ink substantially immediately thereafter by heater 104 while printhead is traversing in direction 108. Then when traversing in direction 110, where ink from printhead 96 is deposited, this ink is substantially dried by heater 106. Additional traversing along paths 108 and 110 are completed for the depositing of ink from printhead 100, dried by dryer 104, and depositing ink from printhead 98 which is dried by dryer 106, as appropriate. Thereafter, the recording medium is moved a preselected distance in direction 112, to continue the printing process to the end of recording medium 92. RF energy is supplied to the printheads through transmission lines 114, and the image to be displayed and control of the heat amount depending upon that image is provided by signals from controller 116.

The invention has been described with reference to the preferred embodiments thereof, which are illustrative and not limiting. Various changes may be made without departure from the spirit and scope of the invention as defined in the appended claims.

What is claimed is:

1. A method of printing using a liquid ink printing device comprising:

depositing a first high surface tension ink on a recording medium;

drying the first high surface tension ink, substantially immediately after depositing of the first high surface tension ink, prior to the first high surface tension ink being absorbed into the recording medium, by applying heat directly to the first high surface tension ink;

depositing a second high surface tension ink on the recording medium, after the first high surface tension ink has been substantially dried; and drying the second high surface tension ink, substantially immediately after depositing of the second high surface tension ink, prior to the second high surface tension ink being absorbed into the recording medium, by applying heat directly to the second high surface tension ink.

2. The method according to claim 1 further including, depositing a third high surface tension ink on the recording medium;

drying the third high surface tension ink on the recording medium, substantially immediately after depositing of the third high surface tension ink, prior to the third high surface tension ink being substantially absorbed into the recording medium, by applying heat directly to the third high surface tension ink;

depositing a fourth high surface tension ink on the recording medium, after the previous high surface tension ink has been substantially dried; and drying the fourth high surface tension ink on the recording medium, substantially immediately after depositing of the fourth high surface tension ink, prior to the fourth high surface tension ink being substantially absorbed into the recording medium, by applying heat directly to the fourth high surface tension ink.

3. The method according to claim 1 wherein each step of drying includes imparting thermal energy to a same surface of the recording medium on which the liquid ink was deposited.

4. The method according to claim 1 wherein the printing on the recording medium takes place on two sides of the recording medium.

5. The method according to claim 1 further including, sensing the amount of each high surface tension ink being deposited on the recording medium; and adjusting the amount of a drying energy supplied to each high surface tension ink dependent upon the sensed amount.

6. The method according to claim 1 wherein each high surface tension ink is a liquid having a greater than 40 dynes per centimeter surface tension value.

7. The method according to claim 1 wherein each high surface tension ink is a liquid which will take longer than three seconds to be absorbed by the recording medium.

8. The method according to claim 1 wherein the drying steps include drying the first high surface tension ink and the second high surface tension ink with at least one of radiant heating, air heating, gas heating, microwave heating, and convection heating.

9. The method according to claim 1 wherein an optical density of an image on the recording medium is greater than 1.3.

10. The method according to claim 1 wherein the depositing and drying steps occur within a print zone, and further include:

rotating a rotatable drum to which at least a portion of the recording medium is in contact in order to move the recording medium, locating first and second liquid ink printheads exterior to the drum in a fashion wherein the depositing steps occur while the recording medium is being moved by the rotating drum, supplying the first and second liquid ink printhead via ink supply lines which are connected to the printheads, carrying the first and second liquid ink printheads on a curved carrier configured to have the printheads facing the recording medium, and locating first and second drying apparatuses within an operational distance of the rotating drum for drying of the first and second high surface tension inks, wherein the configuration of the print zone permits substantially immediate active drying by the first and second drying apparatuses, after ink drops are applied to the recording medium.

11. A method of printing using a liquid ink printer in which liquid ink is deposited, in response to image data, on a recording medium within a print zone, the method of printing comprising:

positioning a first liquid ink printhead containing a first high surface tension liquid ink, within the print zone;

depositing the first high surface tension liquid ink on the recording medium while in the print zone, in response to the image data;

positioning a first drying apparatus in relationship to the first liquid ink printhead such that the first drying apparatus is located after the first liquid ink printhead in the print zone;

drying, by the first drying apparatus the first high surface tension ink deposited on a surface of the recording medium, substantially immediately after depositing of the first high surface tension ink, and before the first high surface tension ink is absorbed into the recording medium, by applying heat directly to the first high surface tension ink;

positioning a second liquid ink printhead so as to operate within the print zone;

depositing a second high surface tension liquid ink from the second liquid ink printhead on the recording medium while in the print zone, in response to the image data, after the first high surface tension ink has been substantially dried;

positioning a second drying apparatus in relationship to the second liquid ink printhead such that the second drying apparatus is located after the second liquid printhead in the print zone; and drying the second high surface tension ink deposited on the surface of the recording medium, substantially immediately after depositing of the second high surface tension ink, by applying heat directly to the second high surface tension ink, wherein the first drying apparatus is positioned between the first printhead and the second printhead such that the first high surface tension ink is substantially dried before the second high surface tension ink is deposited on the recording surface.

12. The method according to claim 11 wherein an optical density of an image printed on the recording medium is greater than 1.3.

13. The method according to claim 11 wherein the high surface tension ink requires more than three seconds to be absorbed into the recording medium.

14. The method according to claim 11 wherein the drying steps include drying the first high surface tension ink and the second high surface tension ink with at least one of radiant heating, air heating, gas heating, microwave heating, and convection heating.

15. The method according to claim 11 wherein the high surface tension ink has a surface tension greater than 40 dynes per centimeter.

16. The method according to claim 11 further including, positioning third and fourth liquid ink printheads so as to operate within the print zone;

depositing a third high surface tension ink on the recording medium by the third printhead; and depositing a fourth high surface tension ink on the recording medium by the fourth printhead, wherein the first drying apparatus drys the third high surface tension ink prior to the fourth printhead depositing the fourth high surface tension ink, and the fourth high surface tension ink is dried by the second drying apparatus.

17. The method according to claim 11 wherein the depositing and drying steps occur within the print zone, and further include:

rotating a rotatable drum to which at least a portion of the recording medium is in contact in order to move the recording medium, locating first and second liquid ink printheads exterior to the drum in a fashion wherein the depositing steps occur while the recording medium is being moved by the rotating drum, supplying the first and second liquid ink printhead via ink supply lines which are connected to the printheads, carrying the first and second liquid ink printheads on a curved carrier configured to have the printheads facing the recording medium, and locating first and second drying apparatuses within an operational distance of the rotating drum for drying of the first and second high surface tension inks, wherein the configuration of the print zone permits substantially immediate active drying by the first and second drying apparatuses, after ink drops are applied to the recording medium.

18. A method of printing liquid ink on a recording medium within a print zone, by an acoustic ink printer in response to image data, the method comprising:

positioning an acoustic ink printhead arrangement, having at least two printheads in the print zone;

depositing by the acoustic ink printhead arrangement at least two different high surface tension liquid inks on the recording medium;

positioning a drying apparatus in relationship to the at least two acoustic ink printheads, such that following the depositing of a first one of the high surface tension inks onto the recording medium, the drying arrangement substantially drys the first high surface tension ink, by applying heat directly to the first high surface tension ink before the second printhead deposits a second one of the high surface tension inks onto the recording medium, wherein the first and second inks deposited onto the recording medium are dried before the inks are absorbed into the recording medium.

19. The method according to claim 18 further including, sensing the amount of each high surface tension ink being deposited on the recording medium; and adjusting the amount of a drying energy supplied to each high surface tension ink dependent upon the sensed amount.

20. The method according to claim 18 wherein each high surface tension ink is a liquid which a greater than 40 dynes per centimeter surface tension value.

21. The method according to claim 18 wherein each high surface tension ink is a liquid which will take longer than three seconds to be absorbed by the recording medium.

* * * * *